US008556141B1

(12) United States Patent
Ferraiolo

(10) Patent No.: US 8,556,141 B1
(45) Date of Patent: Oct. 15, 2013

(54) BACKPACK WITH INTEGRAL UMBRELLA

(76) Inventor: Lori Ferraiolo, New Haven, CT (US)

( * ) Notice: Subject to any disclaimer, the term of this patent is extended or adjusted under 35 U.S.C. 154(b) by 918 days.

(21) Appl. No.: 12/622,044

(22) Filed: Nov. 19, 2009

Related U.S. Application Data

(60) Provisional application No. 61/199,546, filed on Nov. 19, 2008.

(51) Int. Cl.
*A45B 15/00* (2006.01)

(52) U.S. Cl.
USPC ..... 224/190; 224/576; 224/186; 224/915

(58) Field of Classification Search
USPC ..... 135/16; 224/160, 576, 186, 188–190, 224/645, 650–653, 242, 245, 259, 915
See application file for complete search history.

(56) References Cited

U.S. PATENT DOCUMENTS

| | | | | |
|---|---|---|---|---|
| 2,559,421 | A * | 7/1951 | Garrett | 248/515 |
| D330,455 | S | 10/1992 | Massie | |
| 5,388,603 | A * | 2/1995 | Bauer et al. | 135/16 |
| 5,409,291 | A | 4/1995 | Lamb et al. | |
| 5,915,609 | A * | 6/1999 | Diakoulas | 224/626 |
| 6,053,385 | A | 4/2000 | Ward et al. | |
| 6,076,539 | A | 6/2000 | Richardson | |
| 6,308,722 | B1 | 10/2001 | Christie | |
| 6,866,173 | B2 | 3/2005 | Haber | |
| 7,069,939 | B1 * | 7/2006 | Conde | 135/16 |
| 2004/0232186 | A1 * | 11/2004 | Huang et al. | 224/576 |
| 2008/0078790 | A1 * | 4/2008 | Bolling | 224/190 |
| 2008/0156606 | A1 * | 7/2008 | Entner | 190/102 |
| 2011/0062197 | A1 * | 3/2011 | Cottrell | 224/188 |
| 2011/0147427 | A1 * | 6/2011 | Weaver | 224/576 |

* cited by examiner

*Primary Examiner* — Justin Larson
*Assistant Examiner* — Corey Skurdal
(74) *Attorney, Agent, or Firm* — Montgomery Patent & Design; Robert C. Montgomery

(57) ABSTRACT

A backpack with an integral umbrella that enables a user to be protected by an umbrella without the necessity of having to hold it during use, thus leaving one's hands free for other tasks is herein disclosed. A smaller vertical compartment within the backpack houses the umbrella which is deployed by an actuator mechanism on a shoulder strap portion of the backpack. When deployed, the umbrella extends upward over the top of the user via a sectionalized shaft. In such a manner the user is protected from rain and other elements while walking and wearing the backpack, leaving both hands free to perform other tasks.

16 Claims, 2 Drawing Sheets

BACKPACK WITH INTEGRAL UMBRELLA

RELATED APPLICATIONS

The present invention was first described in and claims the benefit of U.S. Provisional Application No. 61/199,546, filed Nov. 19, 2008, the entire disclosures of which are incorporated herein by reference.

FIELD OF THE INVENTION

The present invention relates generally to common personal umbrellas, and in particular, to a backpack provided with a hands-free user-actuated personal umbrella.

BACKGROUND OF THE INVENTION

Umbrellas have long been a common method of providing relief from various environmental discomforts. In warm climates, large umbrellas are used to provide shade and relief from strong sunlight, in order to provide a user with a more comfortable, cool environment as well as protection from sunburn and the like. Perhaps more commonly, small extendable personal umbrellas enjoy widespread use as a simple and effective means of providing individuals with a degree of protection from precipitation while outdoors. Umbrellas are well suited for keeping a user dry during rainfall, snowfall, and other similar conditions.

The effectiveness of such umbrellas is predicated upon their highly localized area of protection and the ability of a user to stabilize the umbrella in a desired position within his or her immediate area. While this allows umbrellas to provide a user with simple and effective protection, it also entails certain problems and discomfitures. In particular, the small radius of common umbrellas, their handheld design, the fact that they may need to be adjusted due to the angle of the rain, and other similar concerns require a certain minimum expenditure of mental and physical effort on the part of the user. This results in a user having to use at least one (1) hand to properly secure and place the umbrella while simultaneously concentrating on maintaining the umbrella in the proper position. As a result, the user is hampered in many other common activities which may be undertaken while walking the outdoors, such as carrying other items.

Various attempts have been made to provide an umbrella which provides the user with enhanced comfort and simpler use as compared to a common personal umbrella as well as other means of carrying common objects in a hands-free manner. Examples of these attempts can be seen by reference to several U.S. patents. U.S. Pat. No. 5,409,291, issued in the name of Lamb et al., describes combined chair and backpack. The Lamb device is a portable chair which is collapsible into a backpack-type configuration to allow a user to transport the device in a hands-free manner.

U.S. Pat. No. 6,076,539, issued in the name of Richardson, describes an adjustable shield for a backpack. The Richardson device comprises a large hinged canopy-type shield attached to a backpack which may be positioned in an upward position in order to provide a user with cover for his or her head.

Additionally, ornamental designs for a hands-free umbrella exist, particularly U.S. Pat. Nos. D 330,455. However, none of these designs are similar to the present invention.

While these devices fulfill their respective, particular objectives, each of these references suffer from one (1) or more of the aforementioned disadvantages. Many such devices do not provide sufficient stability and customizable positioning for an umbrella. Also, many such devices do not provide an umbrella which is fully collapsible and storable in an unobtrusive manner. In addition, many such devices which incorporate backpacks do not provide full, unencumbered functionality of the backpack in a manner which also allows the user to integrally store an umbrella. Furthermore, many such devices do not allow a user to manipulate or deploy the umbrella in a simple manner while the umbrella is in its desired position. Accordingly, there exists a need for a hands-free umbrella without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a means to provide a backpack with an integral umbrella assembly which allows a user to simply and easily deploy and stably position the umbrella. Thus, the object of the present invention is to solve the aforementioned disadvantages and provide for this need.

To achieve the above objectives, it is an object of the present invention to comprise an umbrella assembly, a canopy, and a backpack shell. The apparatus provides storage of the umbrella and canopy within the backpack shell until. A user may activate the apparatus to automatically deploy the umbrella and canopy in an upward, outward manner.

Another object of the present invention is to comprise the umbrella assembly of a common internal spring-loaded mechanism, similar to standard personal umbrellas, for the deployment of the canopy. The canopy comprises a conventional waterproof textile assembly such as those found on standard personal umbrellas. In one (1) embodiment, the canopy portion may be tilted to a desired angle by means of an adjustable, lockable knuckle disposed on a middle portion of the umbrella assembly.

Yet still another object of the present invention is to further comprise the umbrella canopy portion of common features such as a plurality of strong lightweight metal elements including a mounting bracket, a plurality of telescoping poles, an upper pole, a knuckle, a release mechanism, a release cable, a release actuator, a compartment, and a zipper. The upper pole extends down from the canopy portion and comprise a sturdy hollow metal tubular construction capable of withstanding inclement weather.

Yet still another object of the present invention is to comprise the backpack shell of a conventional water-resistant textile enclosure with standard features such as internal and external compartments, shoulder straps, and a double-puller circumferential zipper. The backpack shell further comprises a primary internal compartment and a mounting bracket to support and store the umbrella assembly.

Yet still another object of the present invention is to comprise the knuckle of a rotary friction device such as a pair of parallel grooved discs, which provides various relative angles and connection via a central shaft and tightening knob. The knuckle provides further mechanical attachment means along a lower portion of one (1) or more telescoping poles which are arranged vertically downward through a partially open zipper into the internal compartment of the backpack shell.

Yet still another object of the present invention is to allow the umbrella assembly to be discreetly stored in the backpack shell by compressing the canopy to a cylindrical form in a normal manner and collapsing the telescoping poles into the compartment. The access zipper may be closed in an expected manner to conceal the umbrella assembly.

Yet still another object of the present invention is to comprise the compartment of a cylindrical enclosure affixed to an upper portion of the backpack shell. The compartment is construct of waterproof materials and has a closed bottom surface in order to provide waterproof containment of any moisture deposited from the umbrella assembly.

Yet still another object of the present invention is to engage the telescoping poles in a stationary release mechanism housing when collapsed. The release mechanism comprises a mount bracket, a release cable, and a release actuator. The release mechanism further comprises an internal latching device which provides an unlatching function enabling automatic deployment of the umbrella when the release actuator is motioned.

Yet still another object of the present invention for the mounting bracket to provide attachment for the release mechanism to an inner vertical surface of the compartment for stability during use.

Yet still another object of the present invention is for the release cable and release actuator to provide an easily accessible means to deploy the umbrella assembly. The cable is routed from the release mechanism to the release actuator which is affixed along a forward surface of one (1) of the shoulder straps. A user motions the release actuator which communicates a force to the release mechanism via the release cable.

Yet still another object of the present invention is to provide a method of utilizing the device that provides a unique means of quickly, stably, and easily deploying an umbrella in an automatic manner while wearing the apparatus in order to provide the user with adjustable, stable, hands-free protection from adverse weather conditions in the manner of a common personal umbrella.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 2:
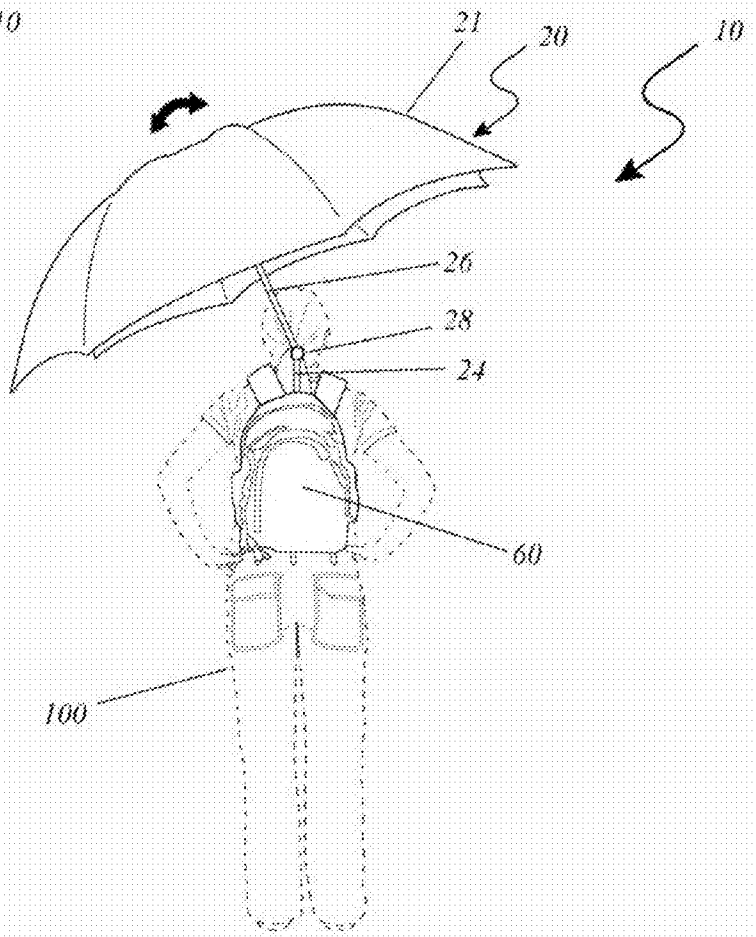
FIG. 2 is another environmental view of a backpack with integral umbrella 10 depicting an angled deployed state, according to a preferred embodiment of the present invention; and, FIG. 3 is a cut-away view of a backpack with integral umbrella 10, according to a preferred embodiment of the present invention.

10 backpack with integral umbrella
15 angle of deployment
20 umbrella assembly
21 canopy
22 mounting bracket
23 weight
24 telescoping pole
26 upper pole
28 knuckle
30 knob
40 release mechanism
42 release cable
44 release actuator
60 backpack shell
62 inner cavity
64 compartment
66 shoulder strap
68 zipper
100 user

DETAILED DESCRIPTION OF THE PREFERRED EMBODIMENT

Figure 1:
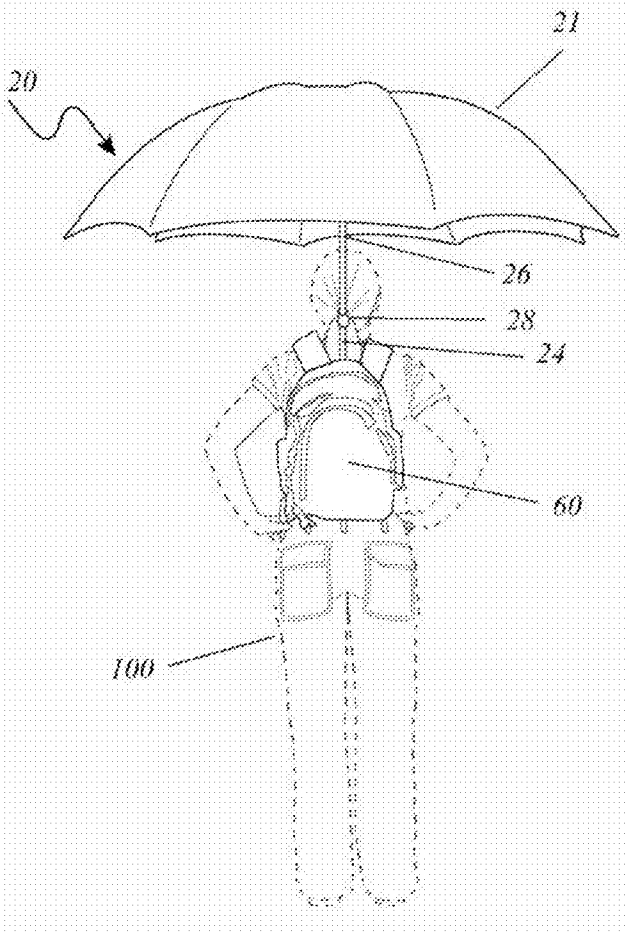
FIG. 1 is an environmental view of a backpack with integral umbrella 10, according to a preferred embodiment of the present invention.
Figure 3:
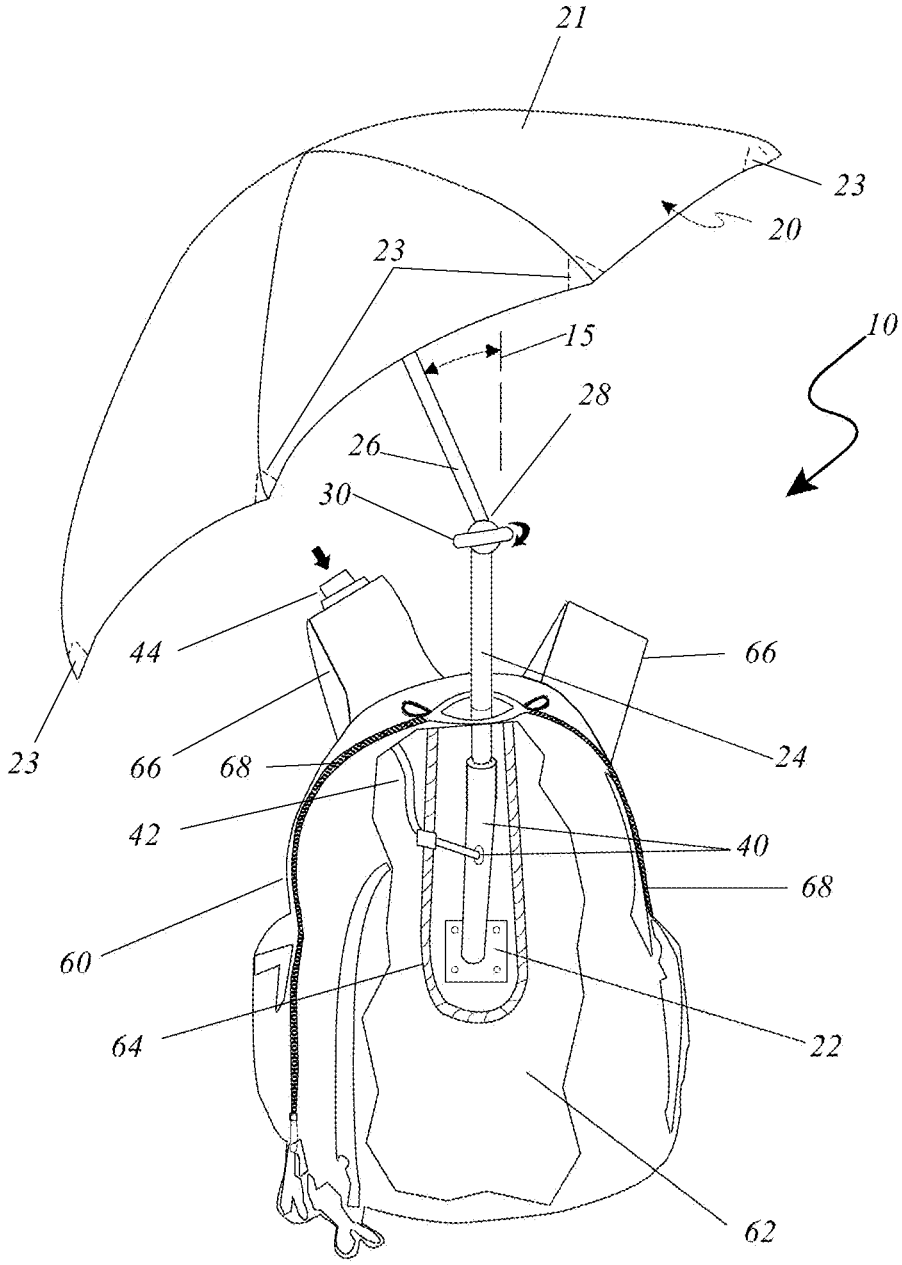

The best mode for carrying out the invention is presented in terms of its preferred embodiment, herein depicted within FIGS. 1 through 3. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a backpack with integral umbrella (herein described as the "apparatus") 10, providing a backpack 60 which deploys and supports a collapsible and internally-mounted umbrella assembly 20 which enables a user 100 to be protected without a necessity of having to hold the umbrella 20 during use. A small compartment 64 near the back section of the backpack 60 houses the umbrella 20 which is deployed by a release actuator 44 such as a button, pull ring, or other activation means being mounted to a shoulder strap portion 66 of the backpack 60. When deployed, the umbrella 20 extends upward over the top of the user 100 via an extendable, telescoping, and spring-loaded shaft 24. The umbrella 20 is envisioned to provide similar function and construction as those found in popular self-deploying umbrellas common in the industry. In such a manner the user 100 is protected from rain and other elements in a hands-free manner while walking and wearing the apparatus 10.

Referring now to FIG. 1, an environmental view of the apparatus 10, according to the preferred embodiment of the present invention, is disclosed. The apparatus 10 comprises an umbrella assembly 20, a canopy 21, and a backpack shell 60. The apparatus 10 provides discreet storage of the umbrella assembly 20 therewithin the backpack shell 60 until needed. Once activated by a user 100, the umbrella assembly 20 is automatically deployed upwardly and subsequently outwardly via automatic deployment of the canopy portion 21 of said umbrella 20. The umbrella assembly 20 comprises automatic deployment of the upper canopy section 21 using internal spring-loaded mechanisms similar to those utilized in many popular umbrella models (see FIG. 3). The canopy 21 is envisioned to comprise a conventional waterproof textile assembly having a plurality of locking ribs, a low-profile arcuate shape, and a plurality of sewn-in metal weights 23 arranged along a perimeter edge thereof, thereby stabilizing the apparatus 10 and minimizing possible effects of wind on the apparatus 10 during use. The backpack shell 60 comprises a conventional water-resistant textile enclosure providing standard features such as, but not limited to: various internal and external compartments, a pair of shoulder straps 66, and a large double-puller circumferential zipper 68. Additionally, the backpack shell 60 comprises a primary internal compartment 64 and mounting bracket 22 to support and store the umbrella assembly 20 (see FIG. 3).

Referring now to FIG. 2, another environmental view of the apparatus 10 depicting an angled deployed state, according to the preferred embodiment of the present invention, is disclosed. The apparatus 10 is illustrated here having the canopy portion 21 tilted to one side at a desired angle of deployment 15 being rotated about a knuckle 28. The knuckle 28 provides an adjustable and lockable angular adjustment means thereto the canopy 21 providing improved protection of the user 100 from rain and other weather elements especially during windy conditions (see FIG. 3).

Referring now to FIG. 3, a cut-away view of the apparatus 10, according to the preferred embodiment of the present invention, is disclosed. The apparatus 10 comprises a traditional textile umbrella canopy portion 21 being supported and expanded via a plurality of strong light-weight metal elements including a mounting bracket 22, a plurality of telescoping poles 24, an upper pole 26, a knuckle 28, a release mechanism 40, a release cable 42, a release actuator 44, a compartment 64, and a zipper 68. The centrally-located upper pole 26 extends downwardly therefrom the canopy portion 21 in an expected manner and comprises a sturdy hollow metal tubular construction capable of withstanding side forces therefrom anticipated winds associated with inclement weather events. The upper pole 26 further provides an angularly adjustable attachment means thereto a one (1) or more telescoping poles 24 via a pivoting knuckle 28. The knuckle 28 is envisioned to comprise a rotary friction device such as a pair of parallel grooved discs or equivalent fixture, thereby providing various relative angles 15 therebetween and being held together via a central shaft and tightening knob 30. The knuckle 28 provides further mechanical attachment means along a lower portion thereto one (1) or more telescoping poles 24 arranged in a vertical orientation extending downwardly therethrough a partially open zipper 68 and into the internal compartment portion 64 of the backpack shell 60. The telescoping poles 24 are envisioned having one (1) or more graduated and inserting diameters being made using a similar tubular construction as the aforementioned upper pole member 26. Said telescoping poles 24 comprise a collapsing compact storage means thereto the umbrella assembly 20 therewithin. In use, the umbrella assembly 20 is discreetly stored therein the backpack shell 60 by compressing the canopy 21 thereto a cylindrical form in a normal manner, and subsequently pressing down and collapsing the telescoping poles 24 thereinto the compartment portion 64. The access zipper 68 is closed in an expected manner to discreetly conceal the umbrella assembly 20 therewithin.

The compartment 64 comprises an enclosure having a closed bottom surface and extending downwardly therewithin an inner cavity 62 of the backpack shell 60, thereby providing waterproof containment of any moisture deposited therefrom the umbrella assembly 20 as well as providing protection thereto any items contained therein said backpack shell 60 from said moisture. The compartment 64 comprises a cylindrically-shaped enclosure affixed thereto an upper portion of the backpack shell 60 and is envisioned being made using waterproof textile materials. When in a collapsed state, the telescoping poles 24 are insertingly engaged therein a stationarily-mounted release mechanism housing 40 which further comprises internal mechanical components required to lock the umbrella assembly 20 therein, as well as spring-loaded elements to automatically expand and deploy the telescoping poles 24 upwardly in a linear manner upon activation of the apparatus 10. The release mechanism 40 further comprises a mounting bracket 22, a release cable 42, and a release actuator 44. The release mechanism 40 is envisioned to comprise an internal latching device which provides retention of the umbrella assembly 20 in a collapsed storage state, as well as providing an unlatching function enabling automatic deployment of the umbrella assembly 20 whenever the release actuator 44 is motioned. The mounting bracket 22 provides to attach the release mechanism 40 thereto an inner vertical surface of the compartment 64 providing both vertical and lateral stability thereto the umbrella assembly 20 during deployment and use. The release cable 42 and release actuator 44 provide a user 100 an easily accessible means to activate deployment of the umbrella assembly 20. The release cable 42 is routed therefrom the release mechanism 40 thereto the release actuator 44 being affixed and routed therethrough one (1) of the shoulder straps 66 along a forward surface thereof. In operation, a user 100 motions the release actuator 44 which communicates a force thereto the release mechanism 40 via the release cable 42.

Finally, the canopy portion 21 of the apparatus 10 is envisioned to comprise a plurality of sewn-in metal weights 23 arranged along a perimeter edge thereof, thereby minimizing possible effects of wind on the apparatus 10 during use.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIGS. 1 and 2.

The method of utilizing the apparatus 10 may be achieved by performing the following steps: wearing the apparatus 10 on one's back using the shoulder straps 66; utilizing the conventional features of the backpack shell 60 to store and transport various personal items in a normal manner; upon experiencing a weather event, opening an upper portion of the zipper 68; motioning the release actuator 44; activating the release mechanism 40; automatically deploying the telescoping poles 24 upwardly and subsequently, the canopy portions 21 outwardly until fully deployed; adjusting to a desired angle of deployment 15 of the umbrella assembly 20 using the knob portion 30 of the knuckle 28, as desired; proceeding to one's destination or commencing to perform a desired task while being protected therefrom foul weather; returning the upper pole 26 to a vertical position upon conclusion of a weather event using the knob 30; manually collapsing the canopy 21 thereto a compact cylindrical shape; pushing downwardly thereupon the canopy 21 and telescoping poles 24; collapsing the umbrella assembly 20 downwardly into the waterproof compartment 64 until securely latched within the housing portion of the release mechanism 40; closing the zipper 68; and, benefiting from effective weather protection while retaining a hands-free capability while utilizing the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A backpack comprising a deployable umbrella, further comprising:

a backpack shell including a primary compartment having an enclosure;

an umbrella assembly attached to said backpack shell; and, a deployment means for deploying said umbrella assembly from said backpack shell;

wherein said backpack provides a discreet storage thereof said umbrella assembly when collapsed therein;

wherein said deployment means comprises:

a release mechanism housing;

an umbrella securing means within said release mechanism housing for securing said umbrella assembly when in a collapsed state; and, a release mechanism within said release mechanism housing for releasing said umbrella assembly from said umbrella securing means, thereby activating said deployment means;

wherein said release mechanism housing is statically mounted entirely within said enclosure.

2. The backpack of claim 1, wherein said backpack shell further comprises a plurality of internal compartments, a plurality of external compartments, a pair of shoulder straps, and a securing means to access an interior.

3. The backpack of claim 2, wherein said enclosure is affixed to an upper portion of a rear of said backpack shell having a closed bottom surface and extending downwardly therewithin an inner cavity of said backpack shell;

wherein said enclosure provides a waterproof containment of any moisture deposited therefrom said umbrella assembly and provides protection thereto any items therein said backpack shell.

4. The backpack of claim 3, wherein said enclosure further comprises a cylindrical shape.

5. The backpack of claim 3, wherein said enclosure further comprises a securable access means.

6. The backpack of claim 5, wherein said enclosure is made from a water-resistant textile.

7. The backpack of claim 1, wherein said umbrella assembly further comprises:

a canopy, comprising a plurality of locking ribs, a plurality of sewn-in metal weights arranged along a perimeter edge thereof;

an upper pole attached at an upper portion to said canopy;

a lower telescoping pole assembly attached at a lower portion to said deployment means; and, a knuckle adjustably connecting said upper pole with respect to an upper portion of said lower telescoping pole assembly, thereby providing an adjustable and lockable angular adjustment means thereto said canopy.

8. The backpack of claim 7, wherein said canopy comprises a low-profile arcuate shape.

9. The backpack of claim 1, wherein said release mechanism further comprises:

a mounting bracket for mounting said release mechanism thereto said primary compartment;

a release actuator affixed to an exterior location of said backpack shell; and, a release cable routed from said release mechanism to said release actuator.

10. The backpack of claim 9, wherein said release actuator is mounted on one of a pair of shoulder straps of said backpack shell.

11. A backpack comprising a deployable umbrella, further comprising:

a backpack shell, comprising a plurality of internal compartments, a plurality of external compartments, a pair of shoulder straps, and a securing means to access an interior;

a primary compartment including an enclosure, wherein said enclosure is affixed to an upper portion of a rear of said backpack shell having a closed bottom surface and extending downwardly therewithin an inner cavity of said backpack shell;

an umbrella assembly, comprising:

a canopy, comprising a plurality of locking ribs, a plurality of sewn-in metal weights arranged along a perimeter edge thereof;

an upper pole attached at an upper portion to said canopy;

a lower telescoping pole assembly; and, a knuckle adjustably connecting said upper pole with respect to an upper portion of said lower telescoping pole assembly, thereby providing an adjustable and lockable angular adjustment means thereto said canopy;

a deployment means for deploying said umbrella assembly from said backpack shell, further comprising:

a release mechanism housing;

an umbrella securing means within said release mechanism housing for securing said umbrella assembly when in a collapsed state; and, a release mechanism within said release mechanism housing for releasing said umbrella assembly from said umbrella securing means, thereby activating said deployment means;

wherein said backpack provides a discreet storage thereof said umbrella assembly when collapsed therein;

wherein said enclosure provides a waterproof containment of any moisture deposited therefrom said umbrella assembly and provides protection thereto any items therein said backpack shell;

wherein said release mechanism housing is statically mounted entirely within said enclosure.

12. The backpack of claim 11, wherein said enclosure further comprises a cylindrical shape.

13. The backpack of claim 12, wherein said release mechanism further comprises:

a mounting bracket for mounting said release mechanism thereto said primary compartment;

a release actuator affixed to one of said pair of shoulder straps; and, a release cable routed from said release mechanism to said release actuator.

14. The backpack of claim 13, wherein said enclosure further comprises a securable access means.

15. The backpack of claim 14, wherein said enclosure is made from a water-resistant textile.

16. The backpack of claim 15, wherein said canopy comprises a low-profile arcuate shape.

* * * * *